US008308079B2

(12) United States Patent
Grether et al.

(10) Patent No.: US 8,308,079 B2
(45) Date of Patent: Nov. 13, 2012

(54) SANITARY INSTALLATION ELEMENT WITH BY-PASS DUCT

(75) Inventors: Hermann Grether, Mullheim (DE); Manfred Gilcher, Neuenburg (DE); Jorg Rudolph, Neuenburg (DE); Christoph Weis, Mullheim (DE)

(73) Assignee: Neoperl GmbH, Mullheim (DE)

( * ) Notice: Subject to any disclaimer, the term of this patent is extended or adjusted under 35 U.S.C. 154(b) by 508 days.

(21) Appl. No.: 12/296,531

(22) PCT Filed: Nov. 28, 2007

(86) PCT No.: PCT/EP2007/010314

§ 371 (c)(1),
(2), (4) Date: Oct. 9, 2008

(87) PCT Pub. No.: WO2008/067936

PCT Pub. Date: Jun. 12, 2008

(65) Prior Publication Data

US 2009/0224067 A1 Sep. 10, 2009

(30) Foreign Application Priority Data

Dec. 6, 2006 (DE) ..... 10 2006 057 795

(51) Int. Cl.

| | |
|---|---|
| ***B05B 15/02*** | (2006.01) |
| ***F23D 11/34*** | (2006.01) |
| ***F23D 11/38*** | (2006.01) |
| ***F23D 14/50*** | (2006.01) |
| ***E03C 1/08*** | (2006.01) |

(52) U.S. Cl. ..... 239/111; 239/106; 239/110; 239/114; 239/118; 239/425.8; 239/553; 239/575; 239/590

(58) Field of Classification Search ..... 239/104, 239/106, 110, 111, 114, 115, 116, 117, 118, 239/123, 428.5, 553, 575, 590
See application file for complete search history.

(56) References Cited

U.S. PATENT DOCUMENTS

| | | | | |
|---|---|---|---|---|
| 2,014,063 | A * | 9/1935 | Brady et al. | 210/106 |
| 3,104,819 | A * | 9/1963 | Aghnides | 239/106 |
| 4,214,702 | A * | 7/1980 | Shames et al. | 239/110 |
| 4,313,564 | A | 2/1982 | Shames et al. | |
| 4,562,960 | A * | 1/1986 | Marty et al. | 239/72 |
| 6,241,880 | B1 * | 6/2001 | Yahr | 210/130 |

FOREIGN PATENT DOCUMENTS

| | | |
|---|---|---|
| DE | 3642356 | 6/1988 |
| DE | 29822353 | 5/1999 |
| DE | 102004044158 | 1/2006 |

* cited by examiner

*Primary Examiner* — Len Tran
*Assistant Examiner* — Ryan Reis
(74) *Attorney, Agent, or Firm* — Volpe and Koenig, P.C.

(57) ABSTRACT

A sanitary installation element (1) having at least one bypass or cleaning duct (6) which is assigned a valve in whose open position the at least one bypass or cleaning duct is connected switched on. The installation element (1) according to the invention is characterized in that the installation element (1) has a filter screen (4) with at least one outlet opening (5), which outlet opening (5) has a larger clear opening cross section than the screen openings of the filter screen (4), that the at least one outlet opening (5) opens into the at least one bypass or cleaning duct (6), and that, as seen in the direction of flow, the outlet opening (5) is arranged in front of at least one liquid-conveying component of at least one functional unit situated in the installation element (1) and, as seen in the direction of flow, the duct outlet of the at least one bypass or cleaning duct (6) is arranged after this component.

24 Claims, 14 Drawing Sheets

SANITARY INSTALLATION ELEMENT WITH BY-PASS DUCT

BACKGROUND

The invention relates to a sanitary installation element with at least one by-pass or cleaning duct, which is assigned a valve, in whose open position, the at least one by-pass or cleaning duct is connected or switched on.

Sanitary installation elements are known, which are embodied as jet regulators that can be inserted into the discharge mouthpiece of a sanitary outlet armature. Such jet regulators are provided to create a homogenous and bubbling-soft water jet and include a jet splitter in the interior of their installation housing, which may be embodied as a diffuser or a perforated plate. While the perforated plate is provided with a multitude of penetrating holes, each creating an individual jet the diffuser is provided with a deflector plate, which is defined by a wall section broken by penetrating openings. These installation elements bear the risk that dirt particles entrained in the water may clog the comparatively small discharge cross-sections of the perforated plate or the diffuser and thus can compromise the function of the functional units provided in the installation elements of prior art.

Therefore, a self-cleaning installation element, embodied as a jet regulator, has been provided (cf. U.S. Pat. No. 4,313,564). This known installation element is provided with a valve, pre-stressed in its open position, which moves into its closed position by a predetermined back-pressure of the water. While the water in the open position of the valve is not only able to flow through the discharge ducts arranged above the valve in the direction of flow, it also flows through by-pass or cleaning ducts arranged above the valve, in the closed position of the valve only the discharge ducts provided above the valve remain open. Through the increased back-pressure of the water during the closing motion of the valve due to the increased speed of the water by the reduced clear opening cross-section as well as the changed guidance of the liquid, an abrasive effect of the water is achieved in the closed position of the valve, which allows loosening and removal potential precipitations in the installation element of prior art. The liquid guidance which changes depending on the back-pressure and the thus changing flow rates simultaneously results in abruptly changing flow characteristics of the discharging water, which is considered disturbing by the user.

From DE 10 2004 044 158 B3, a sanitary installation element is known, which can be inserted into the outlet mouthpiece of a sanitary outlet armature. The installation element of prior art is embodied as a jet regulator insert, which can be switched between a forceful cleaning jet and a soft aerated full jet. For this purpose, the jet regulating insert of prior art is provided with a central cleaning jet duct, surrounded by an annular flow chamber having a multitude of water discharge nozzles. The flow chamber provided to create the soft aerated full jet is provided with an inlet opening, which can be controlled in its closed position by a pre-stressed valve such that the valve can be opened by the inflowing water at the predetermined back-pressure of the water. While the cleaning jet can be advantageously used to clean a razor, for example, in case of a valve opened by the water pressure, a soft jet comprising a multitude of individual jets is created in addition to the cleaning jet. Due to the fact that the so-called soft jet also includes the forceful cleaning jet, here always a combined jet with a splashing center results, which is experienced as relatively uncomfortable, even when the water pressure is appropriate. Also, the cleaning jet of the above-mentioned jet regulator is used for external cleaning purposes only, and not for a self-cleaning of the jet regulator for the purpose of maintaining the functions of its intended purpose.

SUMMARY

Therefore the object is to provide a sanitary installation element of the type mentioned at the outset which is characterized in the functional units located therein being trouble-free and of low maintenance and allowing the formation of a homogeneous water jet independent from the water pressure.

This object is attained according to the invention comprises in an installation element of the type mentioned at the outset, in particular, in that the installation element has a filter screen with at least one outlet opening, which outlet opening is provided with a clear opening cross-section enlarged in reference to the screen openings of the filter screen, the at least one outlet opening opens into at least one by-pass or cleaning duct, and that the outlet opening is arranged upstream in the direction of flow and the duct outlet of the at least one by-pass or cleaning duct is downstream in the direction of flow, of at least one liquid-conveying component of at least one functional unit located in the sanitary installation element.

The installation element according to the invention is provided with a filter screen having at least one outlet opening, which traps and can collect dirt particles entrained in the water, in order to remove them via its outlet opening. In order to allow these dirt particles to be removed from the inlet side of the filter screen, the outlet opening of this filter screen is provided with a clear opening cross-section enlarged in reference to the screen openings. The at least one outlet opening opens into at least one by-pass or cleaning duct, through which the collected dirt particles can be removed. Here, the at least one outlet opening of the filter screen is arranged upstream in the direction of flow of at least one liquid-conveying component of a functional unit located in the installation element and the duct outlet of the by-pass or the cleaning duct is arranged downstream thereof in the direction of flow. The installation element according to the invention is therefore characterized in a comfortable operating mode and constant flow rates. Due to the fact that the dirt particles, which potentially compromise the functionality of water-conveying components, can be removed via the by-pass or cleaning duct during the interruption of the water supply, simultaneously a low-maintenance and trouble-free functionality of the installation element according to the invention as well as the functional units located therein is ensured.

Regardless if the valve is pressed into its open position by a return spring or can be manually set to its open position, it is advantageous for at least one valve to be movable from its open position into its closed position under the back-pressure of the inflowing water.

A preferred and particularly advantageous embodiment according to the invention provides that the installation element is embodied in a self-cleaning fashion and that for this purpose, the at least one valve can be moved under the back-pressure of the inflowing water against a reset force into its closed position. In this embodiment the valve is generally held in its open position by the return force. Due to the fact that under the back-pressure of the inflowing water, the valve can be moved from its open position, against the reset force, into its closed position, the valve is held in its closed position by the inflowing water, in order to only open with an interruption of the water flow, simultaneously closing the outlet armature, such that the collected dirt particles can be removed. In this way, the dirt particles endangering the functionality of a water-conveying component can be removed via the by-pass or cleaning duct during the interruption of the water supply, which occurs regularly when closing the outlet armature which controls the water flow.

A preferred embodiment according to the invention provides that the installation element is provided with a jet regulator as a functional unit and that a jet splitter is provided as at least one of the liquid-conveying components. Due to the fact that particularly the jet splitter of a jet regulator is endangered by dirt particles entrained in the water, due to its relatively small opening cross-section, the installation element according to the invention with its self-cleaning features is particularly suitable in a combination with a jet regulator.

Here, the jet splitter can be embodied as a perforated plate or as a diffuser.

In order to facilitate a trouble-free function of the functional units located in the installation element according to the invention, it is advantageous for at least some of the filter openings of the filter screen to have equally large or smaller clear opening cross-sections in reference to the clear openings of at least one liquid-conveying component. In this way it is ensured that such dirt particles which perhaps have passed the filter openings of the filter screen can definitely pass through the clear openings of the jet splitter.

While the dirt particles entrained in the water, at least to the largest extent, are removed via the by-pass duct it is advantageous for at least one functional unit to be arranged downstream in the direction of flow of the filter openings of the filter screen. In this way, the water jet cleaned by the filter openings of the filter screen is always supplied to at least one functional unit.

A preferred embodiment according to the invention provides for at least one valve having a valve body guided in the installation element in a displaceable fashion against a return force.

Here, a particularly beneficial further embodiment according to the invention provides that a partial sector of the valve body guided through the installation element projects to approximately the water outlet of the installation element and is embodied as a handle for manually operating the valve. The partial section of the valve body projecting beyond the water outlet of the installation element allows not only an indication of the respective operating state of the valve, but also allows the user to trigger further self-cleaning operations from the automatic self-cleaning of the installation element according to the invention, when necessary, moving the valve body at its partial section embodied as a handle into its open position, if necessary.

It is particularly advantageous when the valve body is embodied mushroom or plate shaped.

A preferred embodiment according to the invention provides that the valve body has a guide pin guided in the installation element in a displaceable fashion.

This guide pin is made solidly and can be guided in appropriate guiding openings of the installation element. Another embodiment according to the invention provides that the guide pin is embodied tubular, and the interior of the tube of the guide pin is embodied as a by-pass duct, and that in the upstream end region of the guide pin, at least one inlet for liquids and in the downstream end section of the guide pin at least one outlet for liquids is provided. This way the dirt particles are guided through the interior of the tube of the tubular embodied guide pin, passing the functional liquid-conveying unit. When the tubular guide pin projects from the water outlet of the installation element according to the invention the dirt particles are removed immediately to the outside without allowing them to compromise so much as a single functional unit.

A particularly simple embodiment according to the invention provides that the face opening of the guide pin, preferably protruding from the installation element at the downstream side, is embodied as a discharge unit.

Another, particularly advantageous embodiment according to the invention provides that the valve body is embodied elastically, at least in a shield-shaped partial section, and has an external circumferential seal and that the shield-shaped partial section can be moved from an open position into a closed position against the elasticity of the elastic material. The elastically embodied, shield-shaped partial section of such a valve body can be everted by the backpressure of the inflowing water such that the valve moves from its open position into its closed position. When the backpressure of the water drops, the shield-shaped partial section of the valve body can evert from its closed position into the open position, due to the natural elasticity of the material.

It is particularly advantageous when the outlet opening of the defining edge region of the filter screen is embodied as a valve seat cooperating with the valve body.

In order to allow even large dirt particles in the water to be filtered out it is advantageous when at least one attachment screen is installed upstream in the direction of flow in reference to the installation element. Such an attachment screen effects a preliminary filtering of the inflowing water before the water then passes the filter screen.

It is particularly advantageous when the installation element is provided with a jet regulator as well as a preferably upstream positioned flow regulator as its functional units.

A preferred embodiment according to the invention provides that the filter screen is embodied like a funnel and that the funnel opening of the filter screen serves as the outlet opening. Here, the funnel shaped filter screen may be of an essentially convex or concave funnel-shaped design.

The valve body of the valve allocated to the by-pass duct can be moved against the reset force of a return spring from its open position into its closed position. Another, particularly beneficial embodiment according to the invention provides that the valve body is guided in a displaceable manner by a guide pin that projects from the attachment or filter screen, and that at least one return element comprising an elastic material is provided, which on the one hand is connected to the valve body and on the other hand to the guide pin.

In order to allow guiding the valve body particularly safely at the guide pin, it is beneficial when the valve body annularly encompasses the guide pin. The valve body, on the one hand, and the return element allocated thereto, on the other hand, form an inseparable functional unit when the return element is formed in one piece at the opposite facial edges of the valve body and when the return element is supported with its central area on the upstream face of the guide pin. Here, the return element can be practically fastened at the valve body in the fashion of bellows or suspenders.

A particularly simple and advantageous embodiment according to the invention provides that the return element overlaps the guide pin in a cap-shaped fashion and that the return element with the downstream end of its circumferential edge region is formed in one piece at the valve body.

In a return element overlapping the guide pin in a cap-like fashion it is particularly advantageous for the elastic perimeter of the cap of the return element, comprising an elastic material, to represent the return force. A particularly preferred embodiment according to the invention therefore provides that the valve body is essentially guided in a displaceable fashion through the elastic perimeter of the cap of the return element at the guide pin.

The return element connected to the valve body can be produced from a hard-elastic material and/or allow a longer displacement distance of the valve body when the return element has a cap perimeter embodied as bellows.

BRIEF DESCRIPTION OF THE DRAWINGS

Additional features according to the invention are discernible from the following description of embodiments according to the invention as well as the claims. In the following, the invention is explained in greater detail using the preferred exemplary embodiments:

Shown are.

DETAILED DESCRIPTION OF THE PREFERRED EMBODIMENTS

Figure 2:
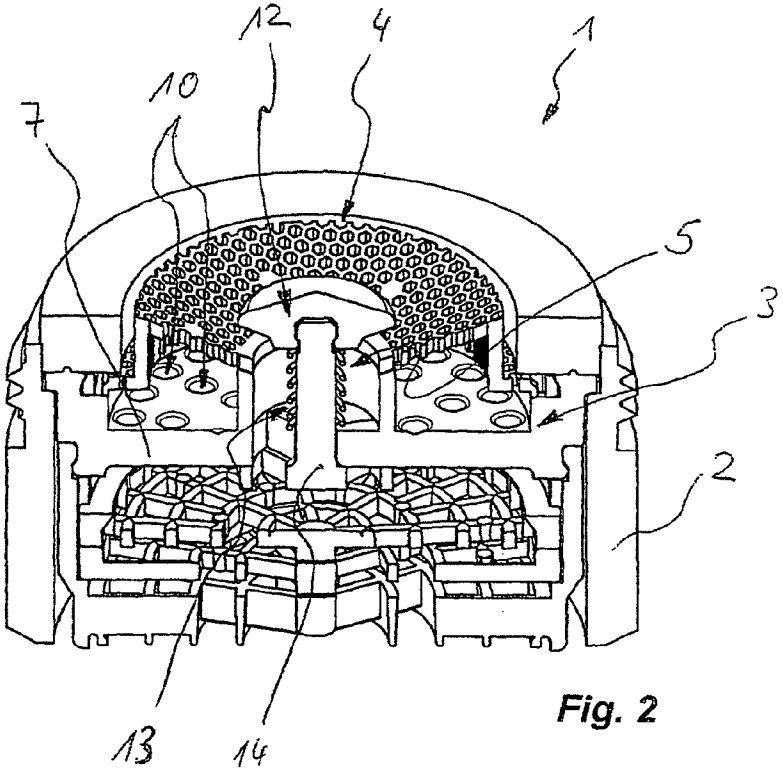

FIGS. 1 through 26 show various embodiments of a self-cleaning sanitary installation element 1. The embodiments of the self-cleaning installation element 1 shown here can be used in the outlet mouthpiece 2 of a sanitary outlet armature not shown in greater detail, here. Each of the installation elements 1 is additionally provided with a functional unit embodied as a jet regulator 3, which serves to form a homogenous or bubbling-soft, aerated or un-aerated, but primarily non-splashing water jet.

The installation elements 1 shown in FIGS. 1 through 26 are provided with a filter screen 4 having a centrally arranged outlet opening 5, with the outlet opening 5 having a clear open cross-section enlarged in reference to the screen openings of the filter screen 4. The dirt outlet opening 5 of the filter screen 4 opens into a by-pass or cleaning duct 6. The filter screen 4 is shaped like a funnel, with the funnel opening of the filter screen 4 serving as the outlet opening 5. Here, the funnel-shaped filter screen 4 has an essentially convex funnel shape, which increasingly tapers in the direction of flow. The funnel-shaped filter screen 4 therefore allows the dirt particles potentially entrained in the water to be effectively trapped and collected at the foot of its funnel shape in the area of the funnel or outlet opening 5. While the water flowing through the filter openings of the filter screen 4 is guided in a cleaned form to the functional units following the filter screen 4, the outlet opening 5 opens into the by-pass or cleaning duct 6, through which the dirt particles collected can be removed. Here, the funnel opening 5 is arranged upstream in reference to the direction of flow of at least one liquid-conveying component of a functional unit located in the installation element, and the duct outlet of the by-pass duct 6 is arranged downstream in the direction of flow. The by-pass duct 6 can be controlled with the help of a valve, which is arranged in the proximity of the funnel opening 5 of the filter screen 4. Due to the fact that the valve in the installation elements 1 shown here can be moved from its open position into its closed position due to the backpressure of the inflowing water against a reset force, the valve is always held in its closed position by the inflowing water in order to only open when interrupting the water flow by closing the outlet armature valve such that the dirt particles collected in the area of the funnel opening 5 can be removed. The installation element 1 is therefore characterized in a comfortable functionality with constant flow characteristics. Due to the fact that the dirt particles endangering the functionality of a water-conveying component can be removed via the by-pass duct 6 during the interruption of the water supply, which occurs regularly when the outlet armature controlling the water flow is closed, simultaneously a low-maintenance and trouble-free functionality of the installation element 1 shown here is ensured as well as that of the functional units located therein.

Figure 1:
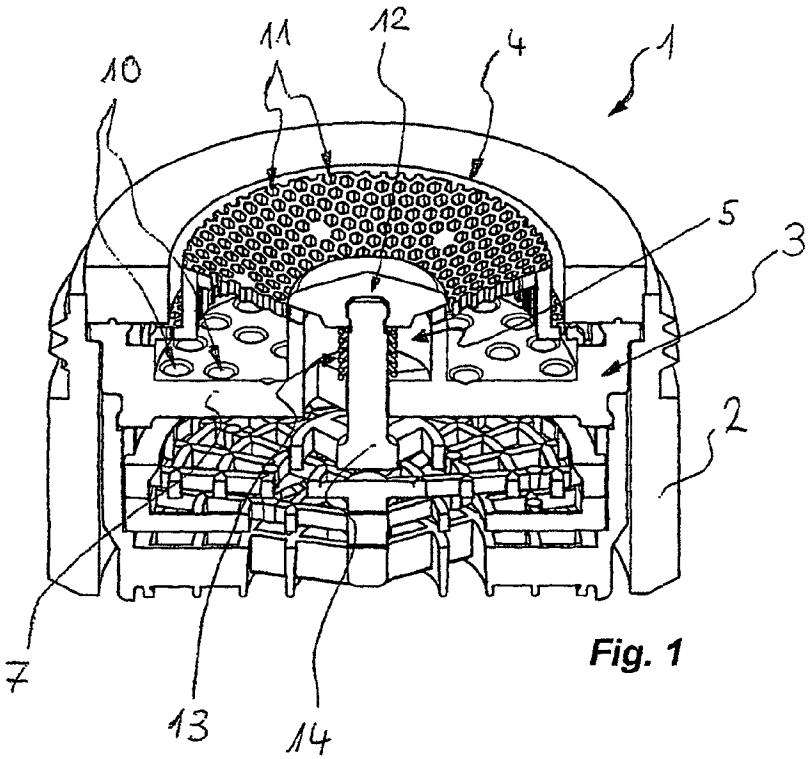
FIG. 1 a perspective, longitudinal, cross-sectional view of a self-cleaning installation element that can be inserted into the outlet mouthpiece of a sanitary outlet armature, with a functional unit being located in the installation element embodied as a jet regulator, which is installed downstream in the direction of flow in reference to the filter openings of a filter screen, and with the filter screen also having a central dirt outlet opening, which opens into a by-pass or cleaning duct, which can be controlled via a valve, here shown located in its closed position, FIG. 2 a view of the installation element of FIG. 1 in the open position of the by-pass duct controlling valve, FIG. 3 a view of an installation element comparable to FIGS. 1 and 2, in its closed position, provided with a valve having a guide pin projecting from the installation element with the projecting end section of the guide pin being embodied as a handle for manually operating the valve, FIG. 4 a view of the installation element of FIG. 3 in the open position of its valve, FIG. 5 a view of an installation element shown in the closed position of its valve, with its valve having a tubular valve body, with the by-pass duct being provided inside the tube of the tubular valve body, FIG. 6 a view of the installation element of FIG. 5 in the open position of its valve, FIG. 7 a view of an installation element shown in the closed position of its valve, which combines in its installation housing a functional unit embodied as a jet regulator and one embodied as a flow regulator, FIG. 8 a view of the installation element of FIG. 7 in the open position of its valve, FIG. 9 a view of an installation element shown in the closed position of its valve, with the installation element including a jet regulator as its functional unit, which jet regulator has a jet splitter embodied as a diffuser, FIG. 10 a view of the installation element of FIG. 9 in the open position of its valve, FIG. 11 a view of a self-cleaning installation element embodied similar to FIGS. 1 and 2, with an attachment screen being installed upstream thereof, FIG. 12 a view of the installation element of FIG. 11 in the open position of its valve, FIG. 13 a view of an installation element with a valve being in its closed position, with the shield-shaped or mushroom shaped valve body of the valve being produced from an elastic material and which is mobile under the backpressure of inflowing water from its open position against the reset force of the elastic material into a closed position of the valve, FIG. 14 a view of an installation element according to FIG. 13 in the open position of its valve, FIG. 15 a view of an installation element with its valve being in its open position, which valve has an annularly embodied valve body guided in a displaceable manner on a guide pin, with a cap-shaped return element being formed from an elastic material of the valve body overlapping the free end region of the guide pin, FIG. 16 a view of the installation element of FIG. 15 in the closed position of its valve, FIG. 17 a view of an installation element embodied similar to FIGS. 15 and 16 having a valve in its open position, with the valve having a cap-shaped return element with the perimeter of the cap being embodied like bellows, FIG. 18 a view of the installation element of FIG. 17 in the closed position of its valve, FIG. 19 a view of an installation element embodied similar to FIGS. 15 through 18 with a valve being in its open position, said valve being installed upstream in reference to a sheath-like by-pass duct, with the duct outlet opening at the downstream side of the installation element, FIG. 20 a view of the installation element of FIG. 19 in the closed position of its valve, FIG. 21 a view of an installation element similar to FIGS. 19 and 20 with a valve being in its open position, with the valve body being connected to a cap-shaped return element, which return element is embodied like bellows at its cap perimeter, FIG. 22 a view of the installation element of FIG. 21 in the closed position of its valve, FIG. 23 a view of an installation element similar to FIGS. 17 and 18, with the installation element embodied as a jet regulator here having a jet splitter embodied as a diffuser, FIG. 24 a view of the installation element of FIG. 23 in the closed position of the valve, FIG. 25 a view of an installation element similar to FIGS. 15 and 16 illustrated in the open position of its valve, which here is also provided with a jet splitter in the form of a diffuser, FIG. 26 a view of the installation element of FIG. 25 in the closed position of its valve, FIG. 27 a graph of the discharge curve of the installation elements shown in FIGS. 1 through 26 and embodied as flow regulators (continuous line) in reference to the discharge curve of a conventional jet regulator (dot-dash line) embodied according to prior art.
Figure 4:
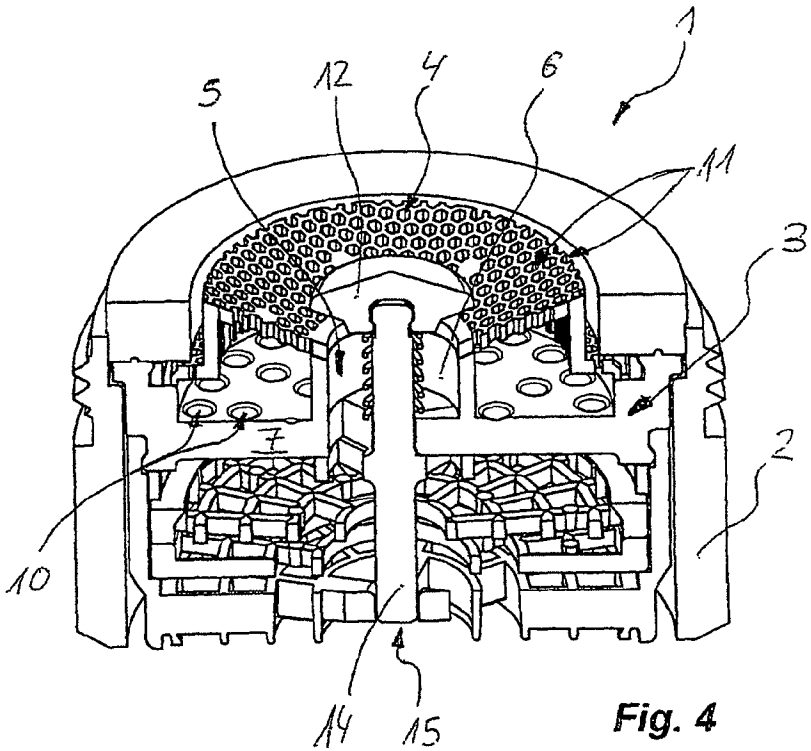
Figure 3:
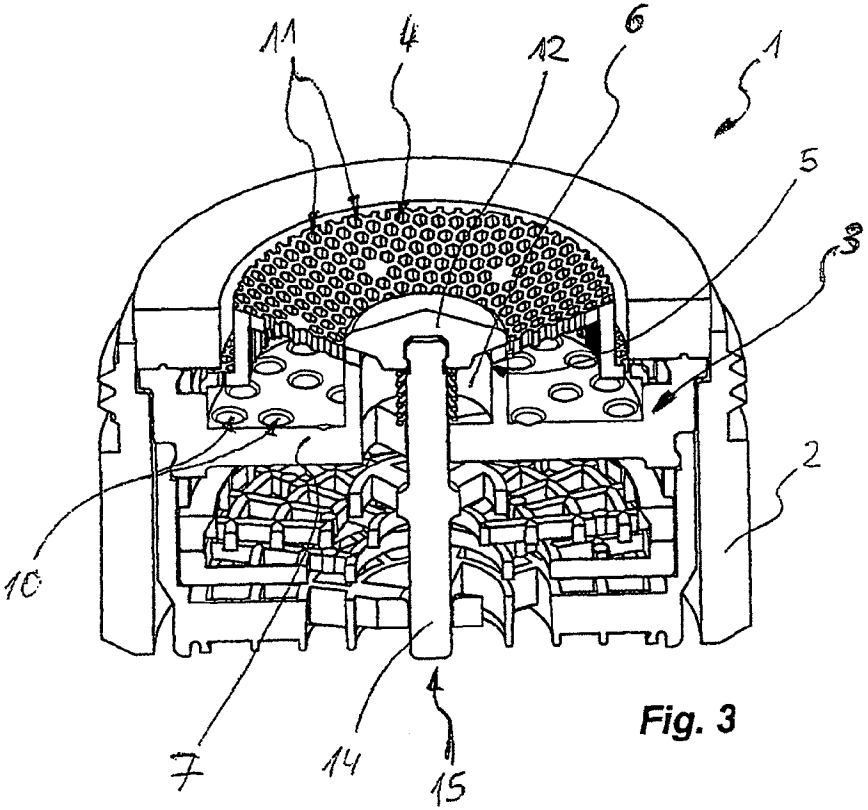
Figure 10:
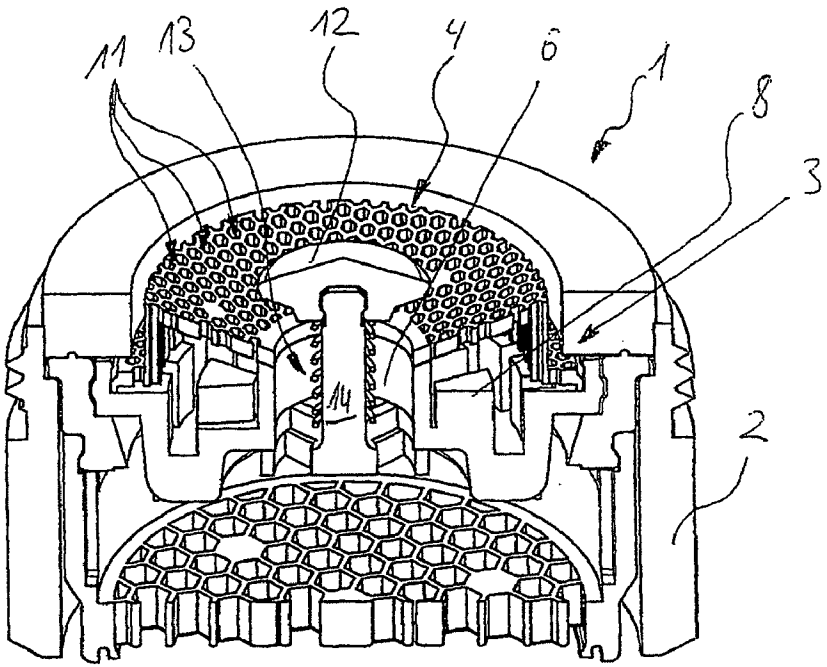
Figure 9:
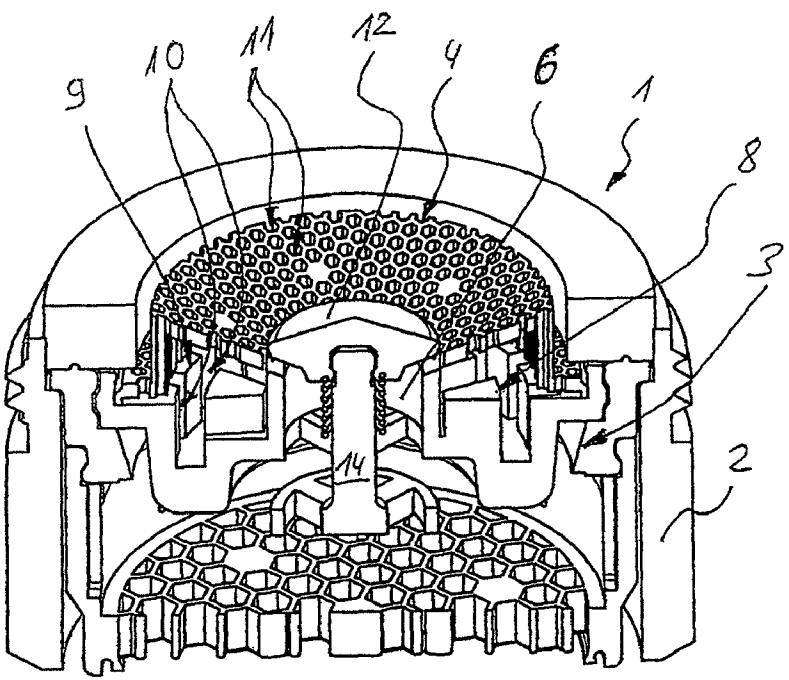

As discernible, for example, from a comparison of FIGS. 1 and 2, on the one hand, and FIGS. 9 and 10, on the other hand, the jet splitter of at least one functional unit embodied as a jet regulator 3 can be embodied either as a perforated plate 7 or as a diffuser 8. While the perforated plate 7 shown in FIGS. 1 and 2 and serving as the jet splitter has a multitude of penetrating openings 10 splitting the inflowing water into individual jets, the diffuser 8 of the jet regulator 3 shown in FIGS. 9 and 10, also embodied as a jet splitter, has a deflector surrounding a circumferential wall 9 broken by penetrating openings 10. Due to the fact that the clear diameter of the penetrating holes or penetrating openings 10 provided in such jet splitters is comparatively small, there is the risk that the perforated plate 7 or the diffuser 8 are clogged by dirt particles entrained in the water and that the orderly function of the installation element 1 is compromised. Using the help of the by-pass duct 6, dirt particles that could compromise the water-conveying component 7, 8 of the jet regulator 3 are kept away from these water-conveying component 7, 8 and filtered off the installation element 1.

Here, the filter openings 11 of the filter screen 4 arranged upstream in reference to at least one functional unit 3 have a clear opening cross-section being at the most of the same size and preferably smaller in reference to the penetrating openings 10 of the at least one liquid-conveying component 7, 8, so that such dirt particles that have passed the filter openings of the filter screen 4 can always also pass through the penetrating openings or penetrating holes 10 of the liquid-conveying component 7, 8.

In the installation elements shown in FIGS. 1 through 12, the shield or mushroom-shaped valve body 12 of the valve can be guided in a displaceable manner in the installation element 1 against the reset force of a return spring 13. For this purpose, the valve body 12 has a guide pin 14, which is guided in a displaceable manner in the respective guiding openings of the installation element 1. The valve body 12 can extend with its guide pin 14 to the components of at least one functional unit 3 positioned downstream in the direction of flow, as illustrated for example in FIGS. 1 and 2. However, it is also possible for the valve body 12 with its guide pin 14 to be guided through the installation element 1 and extend at least to the water outlet of the installation element, with the projecting section of the valve body 12 perhaps embodied as a handle 15. As discernible from FIGS. 3 through 6, the section embodied as a handle 15 and projecting from the installation element 1 allows not only the recognition of the respective open or closed position of the valve body 12, moreover the user can also manually move the valve into its open position by applying pressure to the section of the valve body 12 embodied as a handle, if necessary, when a user-initiated cleaning of the installation element 1 seems prudent.

Figure 6:
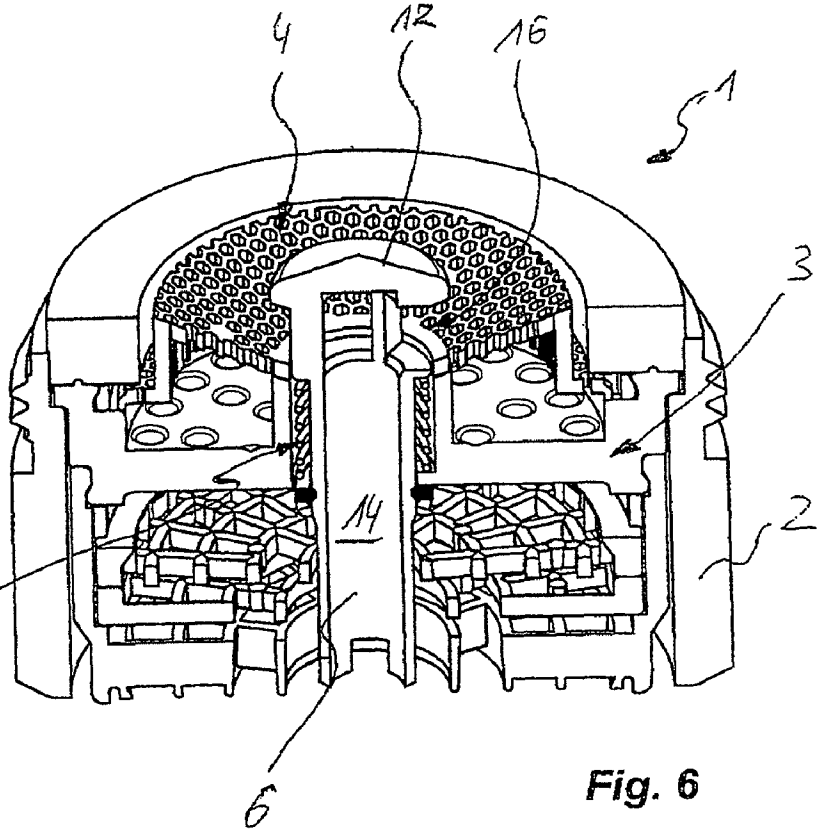
Figure 5:
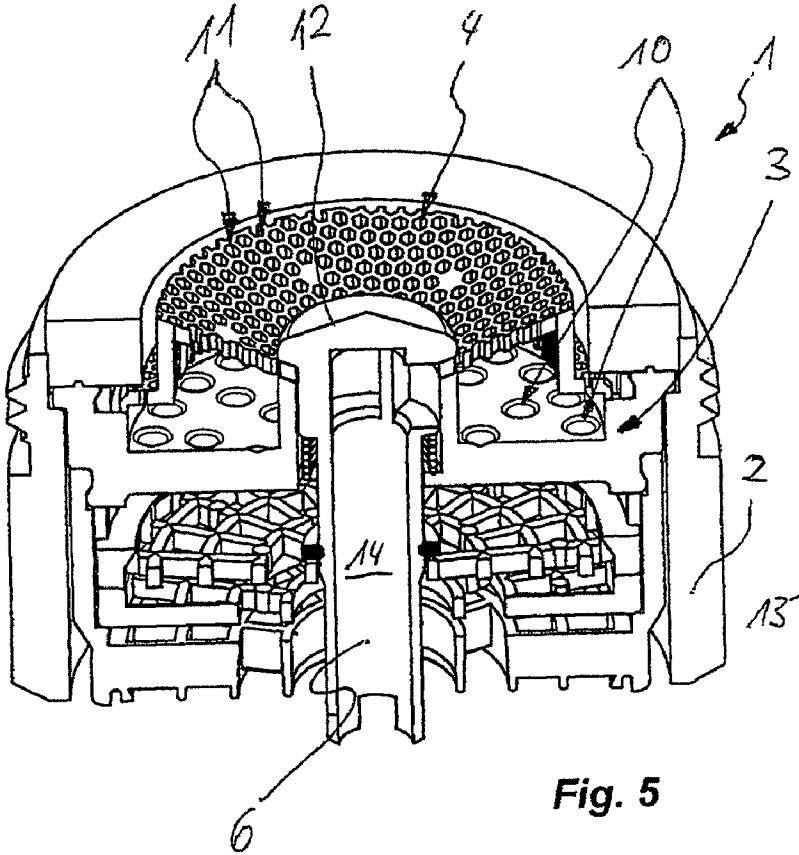

From FIGS. 5 and 6 it is discernible that the section of the valve body 12 projecting to the water outlet of the installation element and embodied as a handle 15 is embodied at its free end section preferably embodied crown-shaped such that any dirt particles located in the guide pin 14 can also be washed out when a user pushes the valve body 12 upward by his/her fingers and closes the flushing opening of the sheath-like guide pin 14.

While the valve body 12 of the installation elements 1 shown in FIGS. 1 through 4 and 7 through 12 are embodied as a solid part combined from two individual parts, the valve body 12 of the installation element 1, shown in FIGS. 5 and 6, is embodied tubular. Here, at least one inlet 16 for liquids is provided below the valve shield cooperating with the valve seat at the upstream end section of the guide pin 14, while the downstream face opening of the tubular guide pin extending at least to the water outlet of the installation element 1 serves as an outlet for liquids. Thus, the dirt particles entrained in the water can be removed through the installation element 1 through the by-pass duct 6 provided inside the tube of the guide pin. This way, even large dirt particles fitting through the tubular guide pin can be removed from the jet regulator without having to pass subsequent functional units of the jet regulator. These subsequent functional units can be embodied and optimized without any consideration of dirt particles entrained in the water.

Figure 14:
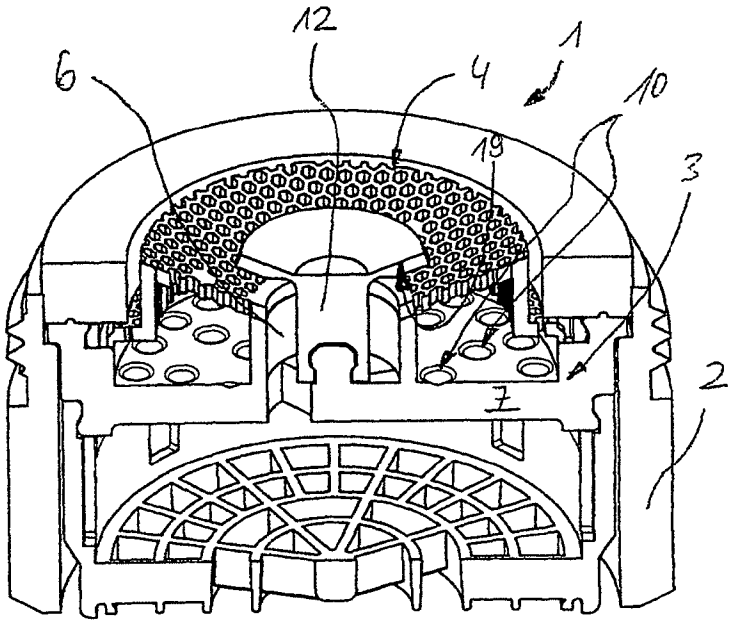
Figure 13:
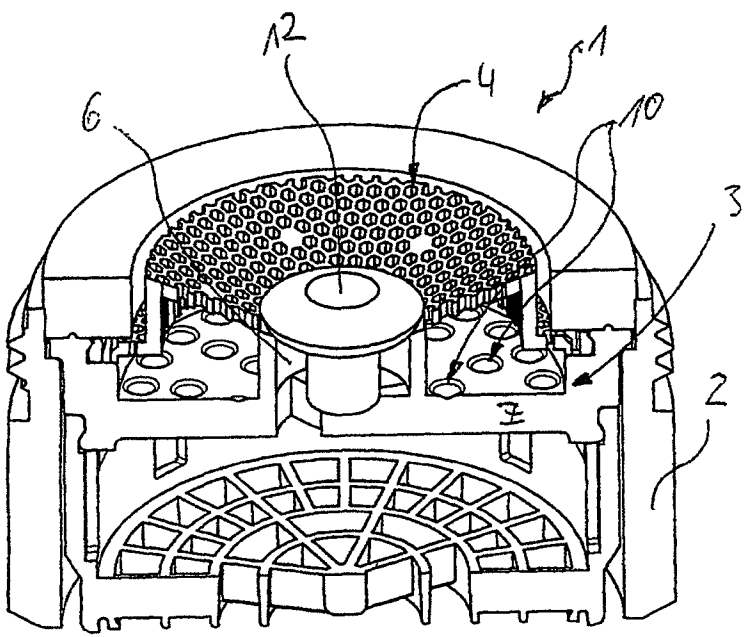
Figure 16:
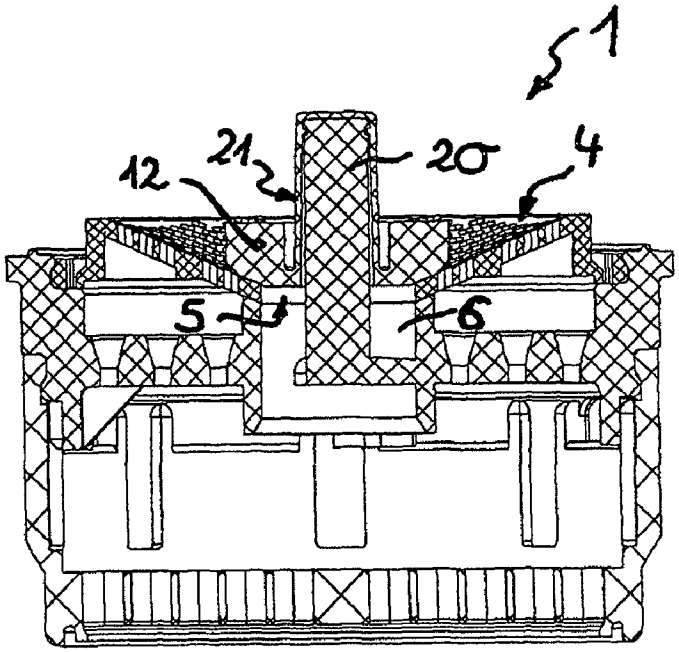
Figure 15:
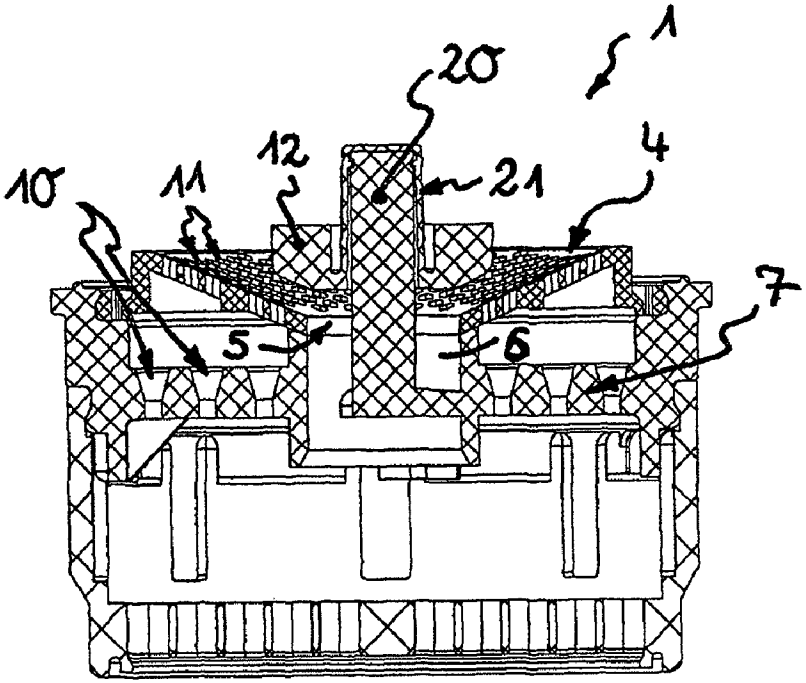
Figure 18:
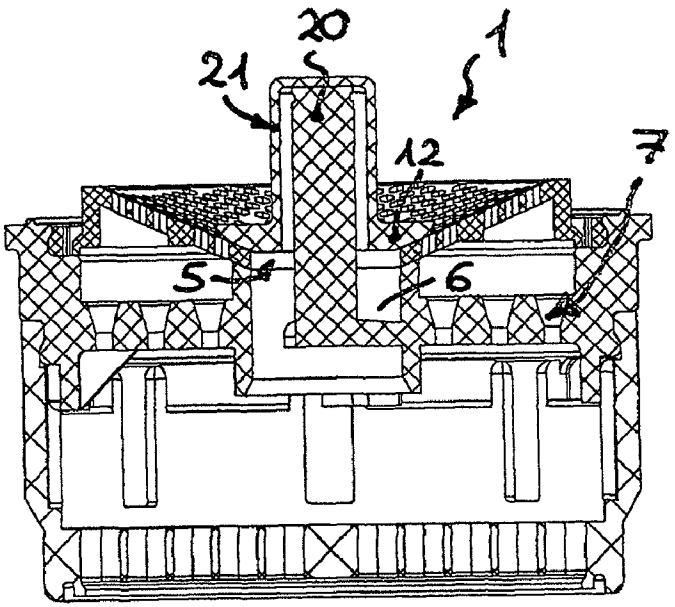
Figure 17:
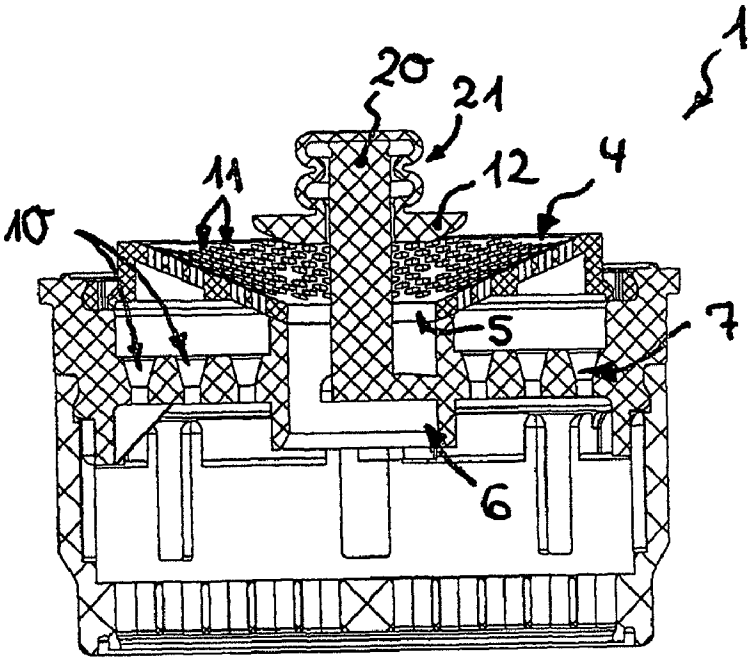
Figure 20:
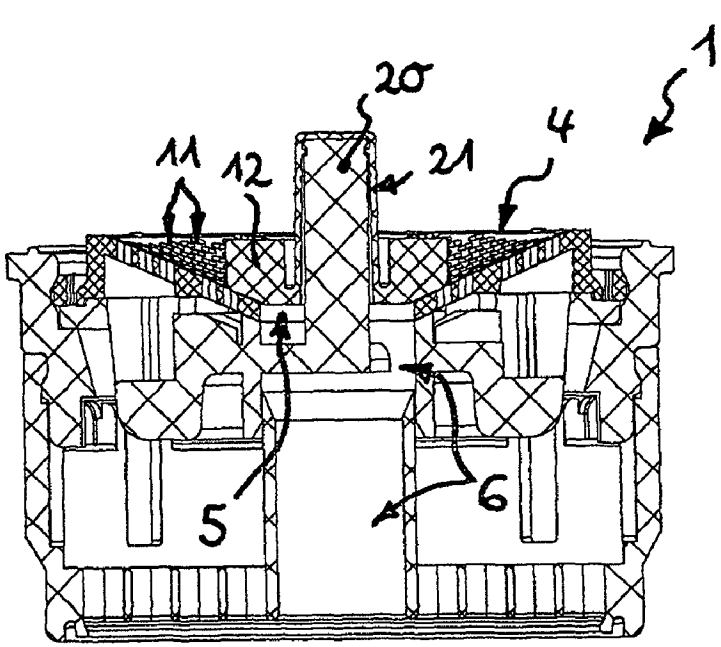
Figure 19:
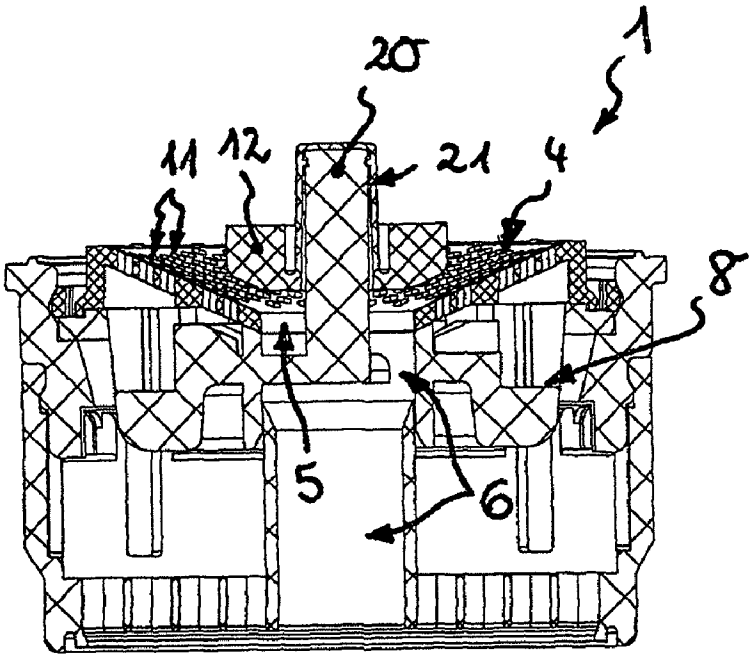
Figure 22:
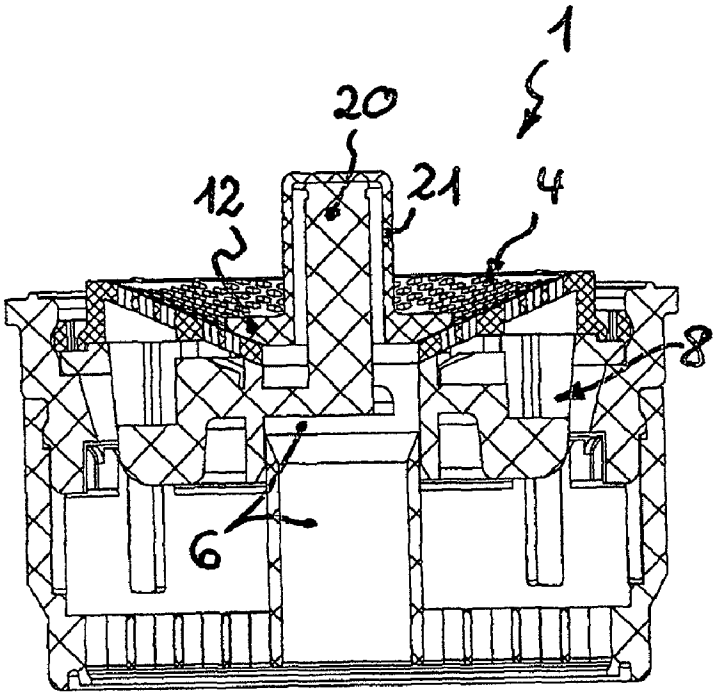
Figure 21:
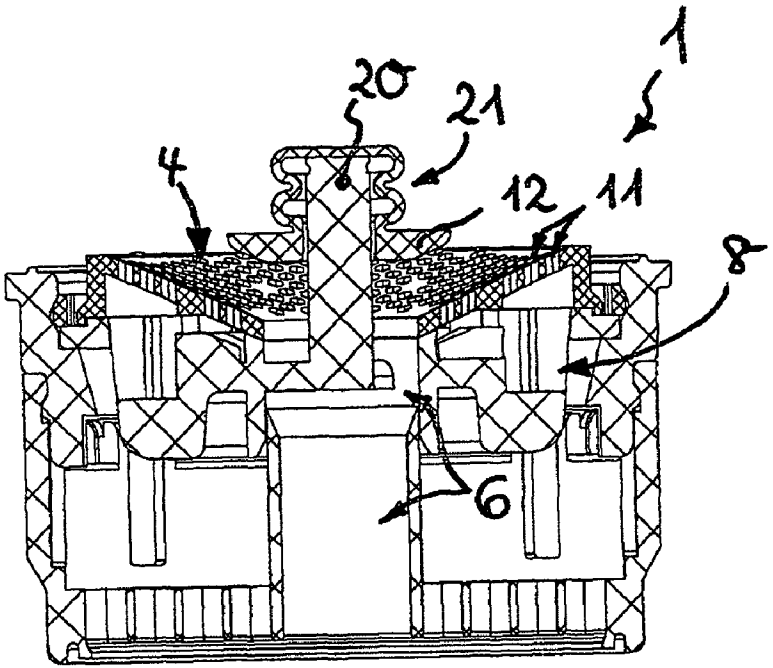
Figure 24:
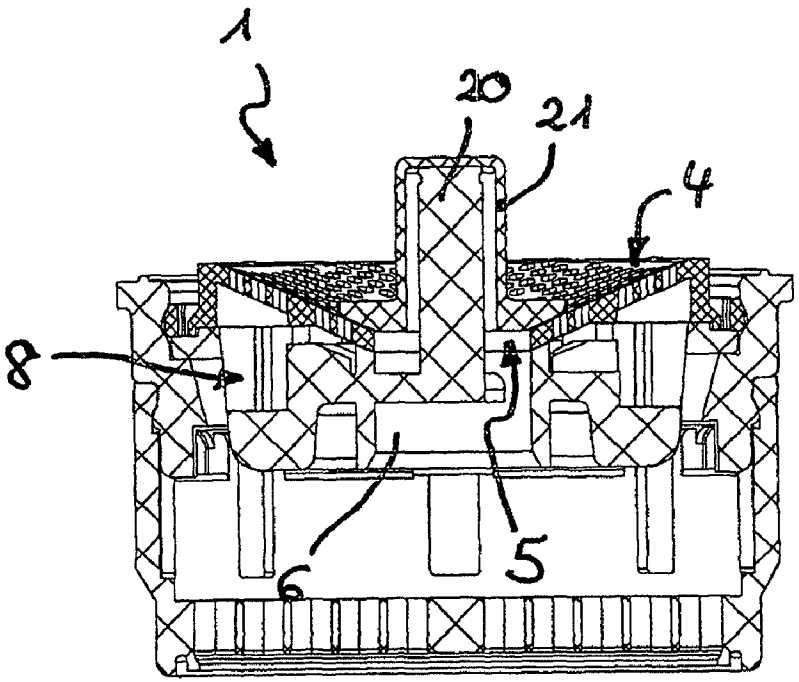
Figure 23:
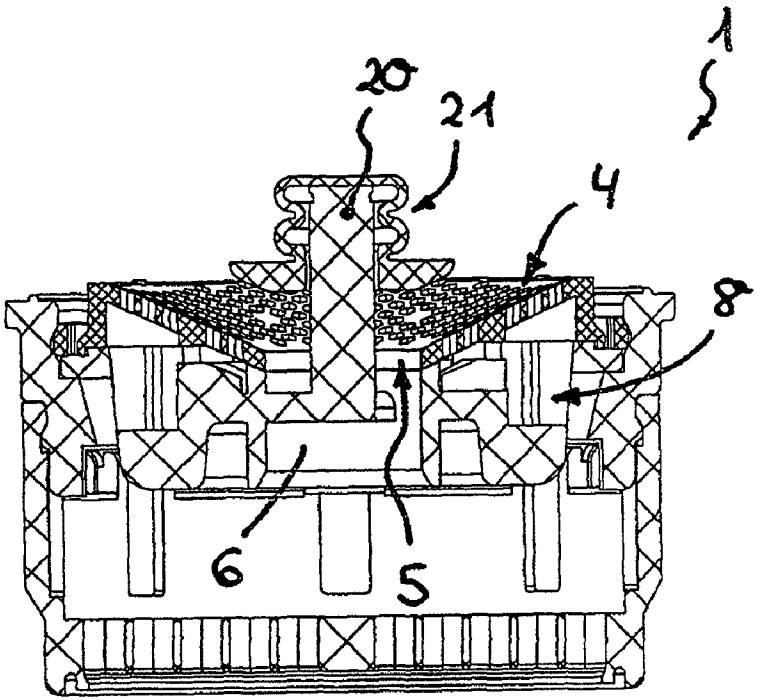
Figure 26:
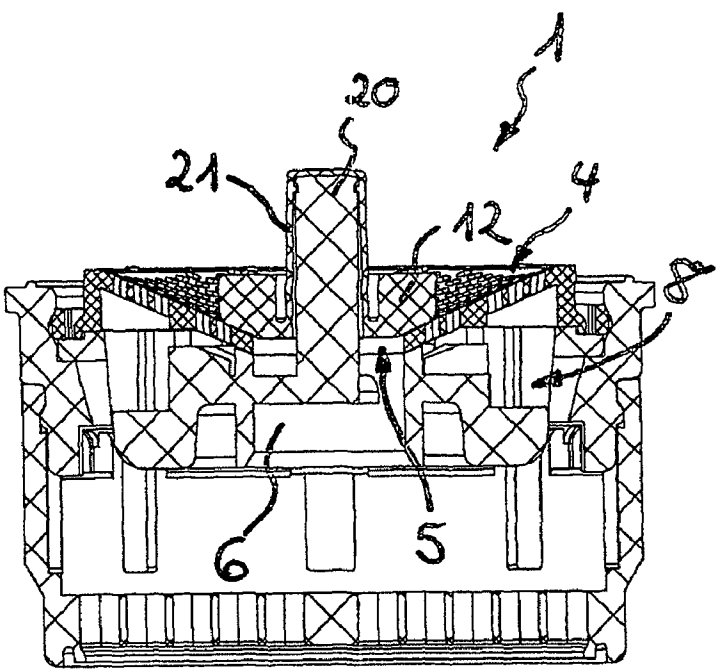
Figure 25:
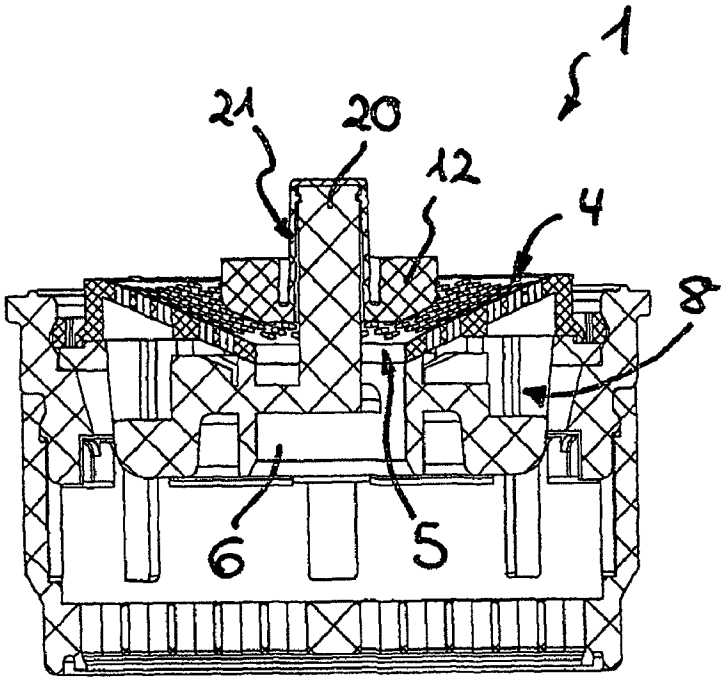

An exemplary embodiment is shown in FIGS. 13 and 14, with its valve comprising an elastic material and being essentially provided with a mushroom or shield-shaped valve body 12. While the shield of the valve body 12 shown in FIGS. 13 and 14 in the open position is opened upwards, the shield of this elastic valve body is everted into the closing position shown in FIG. 13 by the backpressure of the inflowing water against the natural elasticity of the material used.

From the comparison of FIGS. 1, 3, 5, 7, 9, 11, 13, 16, 18, 20, 22, and 24 it is discernible that the valve body 12 in the closed position of the valve contacts the edge area of the filter screen 4 defining the funnel opening 5 and serving as the valve seat.

Figure 12:
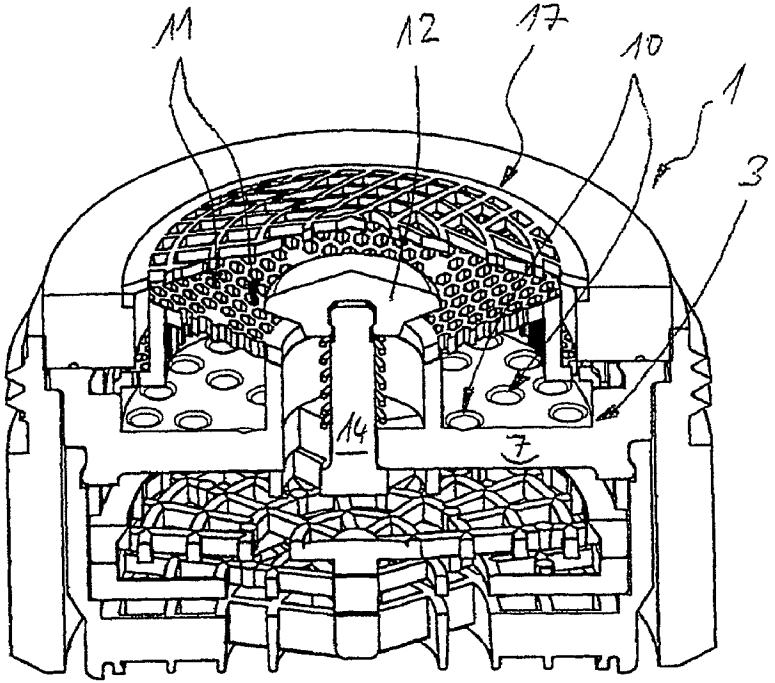
Figure 11:
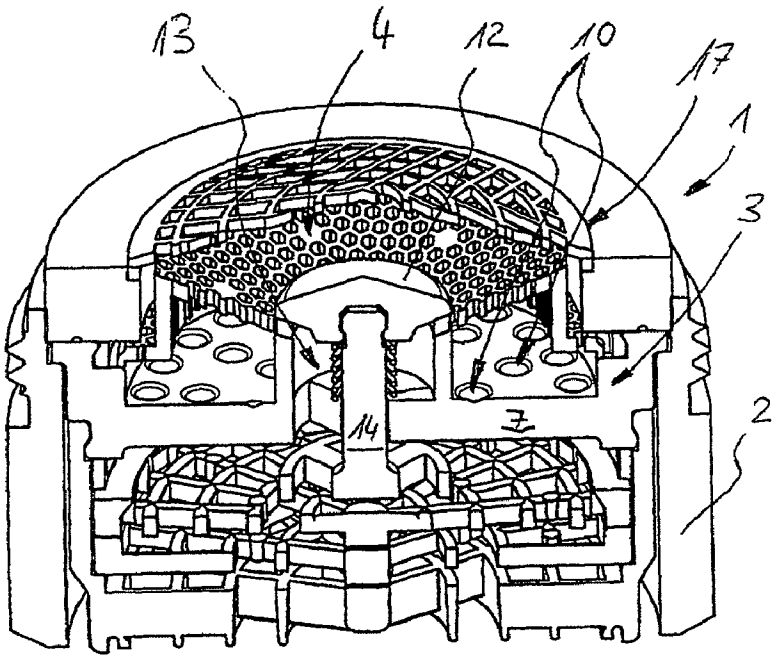

FIGS. 11 and 12 indicate that the installation element 1, if necessary, may also be provided with an attachment screen 17 arranged upstream in the direction of flow. Such an attachment screen 17 can also keep comparatively large dirt particles away from the installation element 1.

Figure 8:
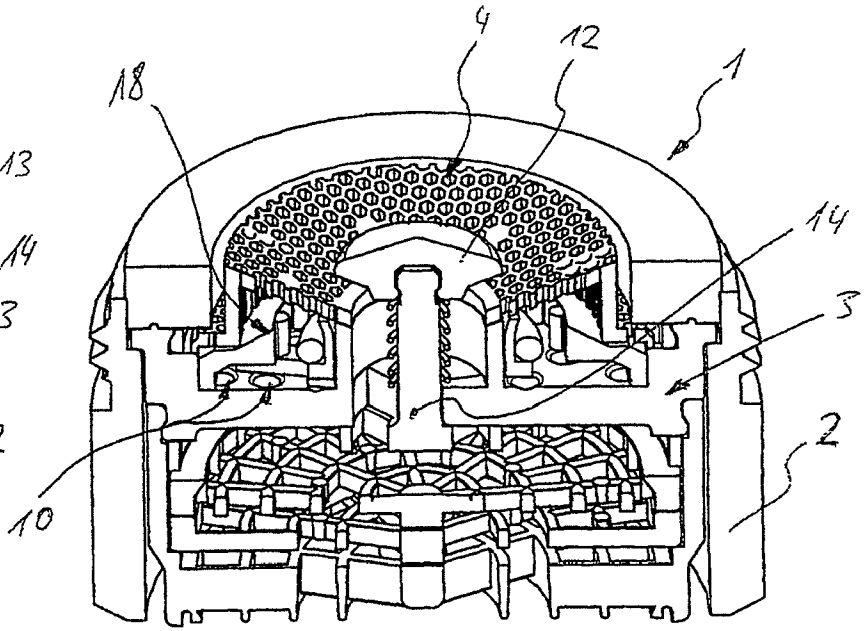
Figure 7:
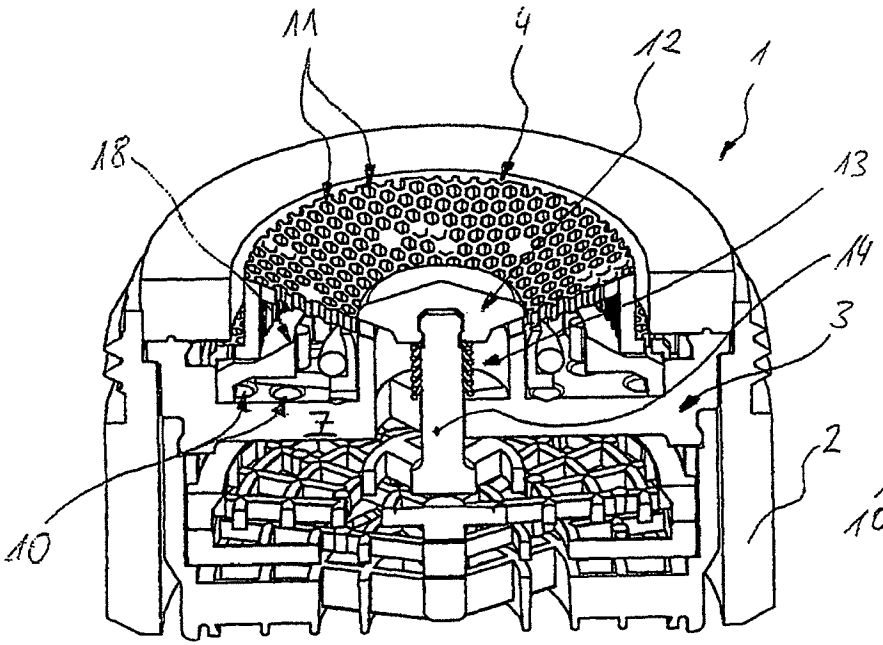

From FIGS. 7 and 8 it is discernible that the installation elements 1 may be provided with a flow regulator 18 as a functional unit additionally or instead of a jet regulator 3. In FIGS. 7 and 8 said flow regulator 18 is positioned upstream in reference to the jet regulator 3 and its jet splitter embodied as a perforated plate 7. Here, the functionality of the flow regulator 18 is ensured by the upstream arranged filter screen.

It is understood that the jet regulator 1 shown in FIGS. 3 through 6 can be provided with a manual operation of the cleaning function without having any return spring 5. When the jet regulators 1 shown in FIG. 3 through 6 are embodied without any return spring 5, the cleaning function is exclusively triggered by a manual actuation of the handle 15; the cleaning then occurs practically "on demand" in a jet regulator 1 embodied in such fashion. By the omission of the return spring 5, a cost-effective production of the jet regulator 1 is additionally facilitated.

As discernible from a comparison of FIGS. 15 through 26 the installation elements 1 illustrated here are provided with a guide pin 20, which penetrates the outlet opening 5 and projects from the attachment or filter screen 4 with its free pin end at the upstream side. A valve body 12 is guided in a displaceable manner on this guide pin 20, annularly encompassing the guide pin 20. A return element 21 made from an elastic material is provided on the valve body 12 of the installation elements 1, shown in FIGS. 14 through 26, which is connected to the valve body 12, on the one hand, and the guide pin 20, on the other hand.

The return element 21 is produced from an elastic material and is embodied like a cap. The cap-shaped return element 21 overlaps the guide pin 20 and is formed in one piece with the valve body 12 with its circumferential edge region at the downstream side such that the return element 21 is connected to the valve body 12 at the opposite facial edges while it is supported with its central area on the face of the guide pin 20 at the upstream side.

While the return element 21 of the installation elements 1 shown in FIGS. 15 through 16, 19 through 20, and 25 through 26 is embodied as a sheath, closed at all sides, the cap-shaped return element of the installation elements shown in FIGS. 17 through 18, 21 through 22, and 23 through 24 is embodied as bellows at the perimeter of the cap.

The by-pass duct of the installation elements 1 shown in FIGS. 15 through 16, 17 through 18, 23 through 24 and 25 through 26 has a duct outlet at the downstream side of the jet splitter following the attachment or filter screen 4. However, the sheath-shaped by-pass duct 6 of the installation elements 1 shown in FIGS. 19 through 20, and 21 through 22, is continued such that the duct outlet penetrates the jet splitter and a downstream jet rectifier and is arranged at the downstream side of the installation element 1.

Here, the jet splitter of the installation elements 1 shown in FIGS. 15 through 16 and 17 through 18 is embodied as a perforated plate 7, while the installation elements 1 shown in FIGS. 19 through 20, 21 through 22, 22 through 23, and 23 through 24 show a diffuser 8 being the jet splitter.

Figure 27:
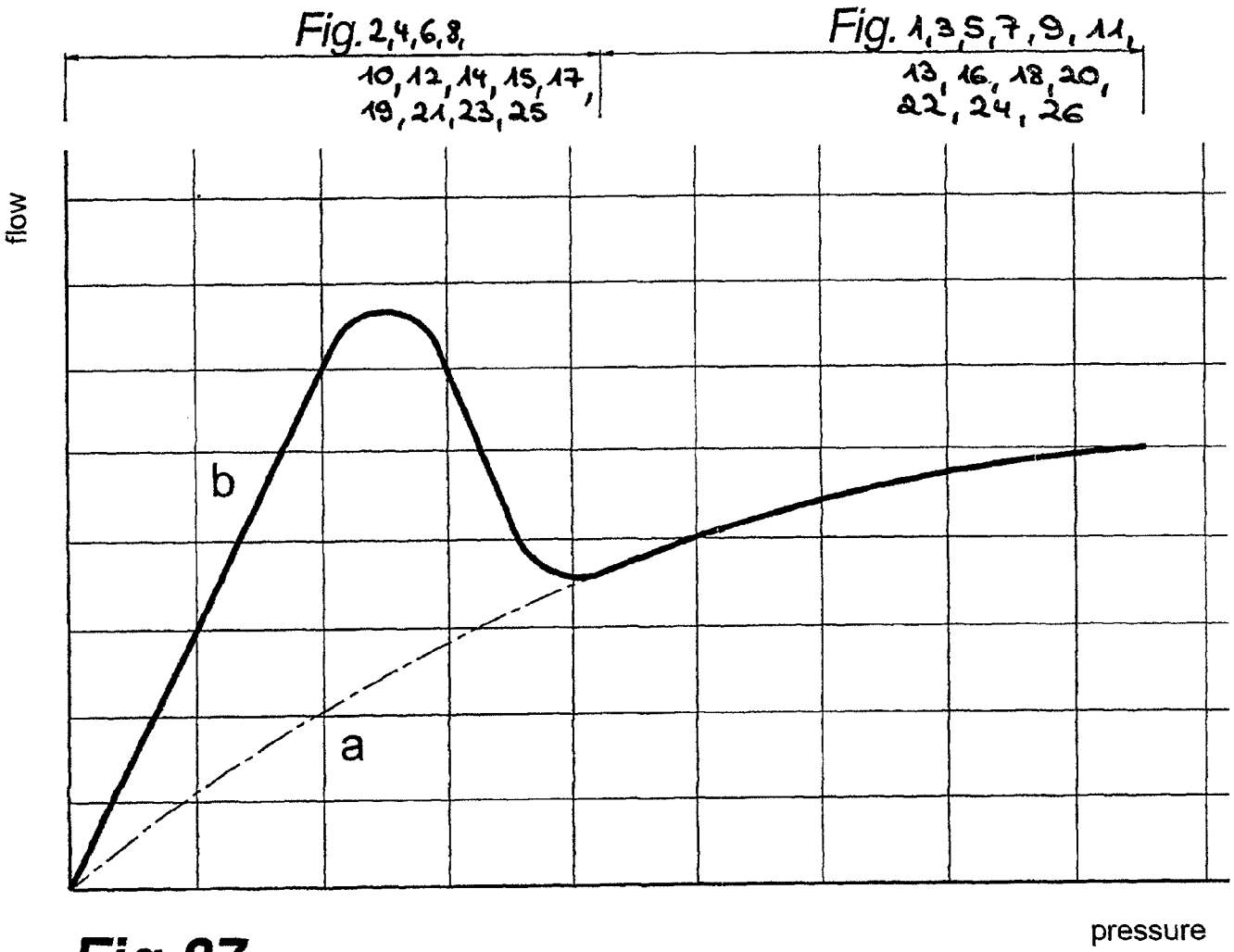

FIG. 27 shows a typical discharge curve that can be yielded by installation elements 1 according to FIGS. 1 through 26. The curve a shown in a dot-dash line shows the discharge behavior of a jet splitter used in prior art, while the curve b shown in a continuous line shows a very steep incline of the discharge in the low pressure range, based on the by-pass effect of the still open valve, which then drops under the increasing pressure based on the valve body 12 closing, and which at a higher pressure coincides with the curve a, which shows the typical discharge behavior of an installation element 1 embodied as a jet regulator having a valve in the closed position.

The invention claimed is:

1. A sanitary installation element (1) comprising at least one by-pass or cleaning duct (6) with a valve being allocated thereto, a filter screen (4) with at least one outlet opening (5), said at least one outlet opening (5) has an enlarged clear opening cross-section in reference to screen openings of the filter screen, the at least one outlet opening (5) opens into the at least one by-pass or cleaning duct (6), and the outlet opening (5) is arranged upstream in a direction of flow and a duct outlet of the at least one by-pass or cleaning duct (6) is arranged downstream in the direction of flow of at least one liquid-conveying component (7, 8) of at least one functional unit located in the installation element, the at least functional unit comprises a jet regulator (3) and the at least one liquid-conveying component comprises a jet splitter which includes a plurality of penetrating openings (10) and surrounds the at least one by-pass or cleaning duct, and the at least one by-pass or cleaning duct is connected to the at least one outlet opening (5) in an open position of the valve, wherein at least one part of filter openings (11) of the filter screen (4) is provided with equal or smaller clear opening cross-sections in reference to penetrating openings of the at least one liquid-conveying component (7, 8).

2. An installation element according to claim 1, wherein the valve can be moved from the open position into a closed position by backpressure of inflowing water.

3. An installation element according to claim 2, wherein the installation element (1) is embodied in a self-cleaning fashion and the valve is moveable under the backpressure of inflowing water into the closed position against a return force.

4. An installation element according to claim 1, wherein the jet splitter is embodied as a perforated plate (7) or as a diffuser (8).

5. An installation element according to claim 1, wherein the at least one functional unit (3, 4) is arranged downstream in the direction of flow in reference to the filter openings (11) of the filter screen (4).

6. An installation element according to claim 1, wherein the valve has a valve body (12) guided in a displaceable manner in the installation element (1) against a return force.

7. An installation element according to claim 6, wherein a section of the valve body (12) guided in the installation element (1) projects at least to a water outlet of the installation element (1) and is embodied as a handle (15) for manually operating the valve.

8. An installation element according to claim 6, wherein the valve body (12) is embodied shaped like a mushroom or a plate.

9. An installation element according to claim 6, wherein the valve body (12) is provided with a guide pin (14) that is guided in a displaceable fashion in the installation element (1).

10. An installation element according to claim 9, wherein the guide pin (14) is embodied tubular, an interior of the tube of the guide pin (14) forms the at least one by-pass or cleaning duct (6), and in an upstream end region of the guide pin (14) at least one liquid inlet is provided and the duct outlet is located at a downstream end region of the guide pin (14).

11. An installation element according to claim 9, wherein a down-stream side of a face opening of the guide pin (14) that projects at least to the water outlet of the installation element (1) is embodied as the duct outlet.

12. An installation element according to claim 9, wherein a down-stream end section of the guide pin (14) is embodied crown-shaped.

13. An installation element according to claim 1, wherein the valve includes a valve body that is embodied elastically at least in a shield-shaped partial section and has at a circular seal at an external perimeter thereof, and the shield shaped partial section can be moved from an open position into a closed position against an elasticity of the elastic material.

14. An installation element according to claim 1, wherein an edge region of the filter screen (4) defining the at least one outlet opening (5) for dirt is embodied as a valve seat cooperating with a valve body (12) of the valve.

15. An installation element according to claim 1, wherein at least one attachment screen (17) is provided upstream in the direction of flow in reference to the installation element (1).

16. An installation element according to claim 1, wherein the installation element (1) is provided with a jet regulator (3) as well as an upstream arranged flow regulator (18) as the functional units.

17. An installation element according to claim 1, wherein the filter screen (4) is embodied funnel-shaped and the funnel opening of the filter screen (4) serves as the at least one outlet opening (5).

18. An installation element according to claim 17, wherein the funnel-shaped attachment or filter screen (4) has an essentially convex or concave funnel shape.

19. A sanitary installation element (1) comprising at least one by-pass or cleaning duct (6) with a valve being allocated thereto, a filter screen (4) with at least one outlet opening (5), said at least one outlet opening (5) has an enlarged clear opening cross-section in reference to screen openings of the filter screen, the at least one outlet opening (5) opens into the at least one by-pass or cleaning duct (6), and the outlet opening (5) is arranged upstream in a direction of flow and a duct outlet of the at least one by-pass or cleaning duct (6) is arranged downstream in the direction of flow of at least one liquid-conveying component (7, 8) of at least one functional unit located in the installation element, and the at least one by-pass or cleaning duct is connected to the at least one outlet opening (5) in an open position of the valve, wherein the valve includes a valve body (12) that is guided in a displaceable manner on a guide pin (20) projecting from the filter screen (4), and at least one return element (21) comprised of an elastic material is connected to the valve body (12) and the guide pin (20).

20. An installation according to claim 19, wherein the valve body (12) annularly encompasses the guide pin (20).

21. An installation element according to claim 19, wherein the at least one return element (21) has opposite face edges formed in one piece with the valve body (12), and the return element (21) is supported with a central region thereof on an upstream face of the guide pin (20).

22. An installation element according to claim 19, wherein the return element (21) overlaps the guide pin (20) in a cap-shaped fashion and the return element (21) is formed with a circumferential edge region in one piece at a downstream side to the valve body (12).

23. An installation element according to claim 19, wherein the valve body (12) is guided on the guide pin (20) in a displaceable fashion, essentially by an elastic perimeter of a cap of the return element (21).

24. An installation element according to claim 23, wherein the cap perimeter is embodied as bellows.

* * * * *